United States Patent [19]

Groitzsch et al.

[11] Patent Number: 4,731,277

[45] Date of Patent: Mar. 15, 1988

[54] NONWOVEN TEXTILE SPONGE FOR MEDICINE AND HYGIENE, AND METHODS FOR THE PRODUCTION THEREOF

[75] Inventors: Dieter Groitzsch, Hirschberg; Hans-Jürgen Kühlwein, Viernheim, both of Fed. Rep. of Germany

[73] Assignee: Firma Carl Freudenberg, Weinheim/Bergstr., Fed. Rep. of Germany

[21] Appl. No.: 879,815

[22] Filed: Jun. 27, 1986

[30] Foreign Application Priority Data

Aug. 8, 1985 [DE] Fed. Rep. of Germany ..... 3528524

[51] Int. Cl.[4] ..... A61F 13/16; A61L 15/01

[52] U.S. Cl. ..... 428/137; 128/156; 156/85; 156/252; 156/256; 156/290; 156/296; 156/308.4; 428/288; 428/296; 428/311.5; 428/311.7; 604/366; 604/370; 604/372; 604/374; 604/378

[58] Field of Search ..... 128/156; 156/252, 256, 156/290, 296, 85, 308.4; 428/137, 288, 296, 311.5, 311.7; 604/366, 370, 372, 374, 378

[56] References Cited

U.S. PATENT DOCUMENTS 4,203,435 5/1980 Krull et al. ..... 128/156
4,519,799 5/1985 Sakurai et al. ..... 604/366

FOREIGN PATENT DOCUMENTS 77034 10/1982 European Pat. Off. .

*Primary Examiner*—James C. Cannon
*Attorney, Agent, or Firm*—Felfe & Lynch

[57] ABSTRACT

Disclosed is a nonwoven, textile sponge for use in medical and hygienic applications consisting of at least one outer, thermally consolidated, moisture-repellent fiber layer containing at least 80% synthetic heterofil filaments and at least one layer of absorbent fibers. The sponge is perforated, but does not have any substantial fiber entanglement, and contains no binding agent of any kind. Also disclosed is a method for the manufacture of the sponge, in which the fiber nonwovens are laid one on the other, hydraulically perforated without fiber entanglement, and then thermally consolidated through heterofil filaments.

15 Claims, 2 Drawing Figures

NONWOVEN TEXTILE SPONGE FOR MEDICINE AND HYGIENE, AND METHODS FOR THE PRODUCTION THEREOF

BACKGROUND OF THE INVENTION

The invention relates to a nonwoven textile sponge for use in the medical and/or hygienic field. Such products usually consist of at least one absorbent fiber layer, mixed in some cases with binding fibers, and at least one waterrepellent outer fiber layer of nonwoven fabric covering it at least on the wound side, through perforations being present over the entire surface of the sponge. The present invention is also in a method for the production of the inventive sponge.

Absorbent textile pads known as sponges are needed in medicine and in hygiene for use as surgical bandages, and as protective or wiping material. In wound treatment, a woven cotton gauze has the disadvantages that it adheres to the wound and has an unsatisfactorily low ability to absorb wound secretions. To reduce the tendency to adhere, unfolded compresses of the absorbent layer of first-aid bandages are covered with moisture-repellent woven synthetic fiber layers.

Thus, in European Patent No. 77,034, a sponge is described, which is made of a core of highly absorbent material with a two-layer covering on at least the side to be applied to the wound. The layer adjacent the core consists of a heat-sealing nonwoven and the outside layer consists of polypropylene fabric with a mesh structure. This latter nonwoven fabric is said to facilitate the absorption of wound secretions into the absorbent layers, due to its sufficiently large, irregular-edged openings, better than perforated polypropylene films, without any clogging of the pores. The heat-sealing nonwoven joining the outer mesh structure to the absorbent layer is thus placed very closely against the wound. The two-layer envelope can be welded at its edges to form a surgical sponge.

On account of this outer, two-layer sandwich construction, however, the ability of the sponges to fold is impaired, although this is often needed for improved absorbency, since under heavy stress they often tend to break at the creases in the wound coverings.

To remedy this, very bulky, non-folding sponges must be made available, which are difficult to handle, and whose packaging costs are considerably increased.

Furthermore, the fact that the polypropylene fabric layer has to be manufactured prior to the manufacture of the pad contributes considerably to the cost increase.

Covering with nonweldable nonwoven covering materials is not feasible on account of the dispersions of polymer binding agents which are then necessary and their content of medically unacceptable soluble additives.

French Patent Application FR-A No. 2,536,432 shows a hydraulic perforating apparatus and a method whereby perforated nonwovens, containing no binding agent and made of mostly cotton fibers, can be made with attritionresistant surfaces, wherein the fibers are entangled with one another by needling with very high-pressure water jets. These products distinguish themselves from cotton gauze by their approximately 50% higher capacity for the absorption of aqueous fluids.

The amount of energy required for the high-pressure water jet needling, however, is very great. This product also tends to stick to the wound on account of the not-inconsiderable content of cotton at the surface.

It is an object of the present invention to provide an absorbent, nonwoven textile sponge whose absorbency is equal to that of perforated rayon and cotton nonwovens, but which contains no binding agent of any kind, is resistant to attrition and free of fluff, which does not adhere to the wound and can be folded as many times as required, without harm. It is also an object of the invention to provide a sponge that can be used in many applications especially in medicine, but also in the field of hygiene. Thus, the formerly incompatible advantages of known medical absorbent articles are to be combined in a single product.

Furthermore, an object of the invention is in providing a low-cost and simple method for the production of such a sponge, whereby the technical complexity and cost of water-jet needling and the use of a two-layer cover of nonwoven and woven materials can be avoided, while dispersing with requiring a binding agent for consolidation.

THE INVENTION

The objects of the invention are achieved by a sponge comprising at least one absorbent fiber layer and at least one perforated water-repellent outer fiber layer covering the absorbent fiber layer on a wound side. The outer repellent fiber layer consists of at least 80% of synthetic heterofil filaments. The filaments have a low-melting and a high-melting component. The fiber layers merged flowingly with one another so that the perforated regions contain no substantial fiber entanglement, and that the entire material is consolidated thermally exclusively by the bonded filaments without binding agents.

The nonwoven, textile sponge for medicine and hygiene, having at least one absorbent fiber layer containing, in some cases, binding fibers, and at least one external layer containing water-repellent fibers, said water-repellent fiber layer having at least 80% synthetic heterofil filaments with a low-melting and a high-melting component is manufactured by covering one of the layers with the other to form a sandwich, hydraulically perforating the sandwich by means of a slotted water nozzle and a hole mask with water streams of such low impact energy that no substantial fiber entanglement develops in the hold areas, and that then drying the perforated sandwich, consolidating the sandwich under pressure at a temperature above the melting point of the low-melting component, without the addition of a binding agent. The fiber layers of the absorbent layer and of the water-repellent covering merge smoothly with one another on account of the fact that they are combined in thin layers, in conjunction with the subsequent binding under pressure, they no longer have definite boundary layers, so that the product according to the invention must be described as a combination of fiber layers, rather than as a laminated material.

The moisture-repellent outer layer contains, according to the invention, at least 80% of synthetic filaments [heterofils]having discrete high-melting and low-melting components. The remaining fibers can be synthetic homofil fibers containing, if desired, a small percentage of cellulosic fibers.

The absorbent fiber layer consists generally of the known cellulosic fiber materials, optionally mixed with other fibers. It is desirable that binding fibers be added for consolidation. In the interest of economical manufacture and of maintaining the loft of the absorbent zone, a content of up to 30% of heterofil filaments of the same kind used in the moisture-repellent cover is advantageous. These binding fibers serve simultaneously to join the absorbent zone to the outer layer or layers.

According to an additional embodiment, the absorbent zone consists entirely of polyvinyl alcohol fibers which can soften in hot water, or contains them together with cellulosic fibers. This configuration has the advantages that binding fibers can be dispensed with, since the polyvinyl alcohol fibers are self-adhesive under the conditions specified, and additionally have a decidedly higher absorptive capacity for aqueous fluids than do cellulosic fibers.

In another advantageous development of the sponge according to the present invention, the absorbent zone consists only of cellulose paper, preferably in several layers. This embodiment is preferred for applications in the hygienic field. Cellulose is cheap, and, even under severe stress in the dry state, has a firm internal consistency such that additions of binding fibers are not necessary.

The sponge according to the invention has perforations distributed over its entire area. However, according to the invention, it does not contain any substantial fiber entanglement contributing to consolidation, even in the area of the holes. The combination is thermally consolidated exclusively through the low-melting component of the heterofil fibers, and its moisture-repellent outer side or sides are free of fluff.

The weight of the finished material is preferably between 30 and 50 grams per square meter, while the percentage by weight of the moisture-repellent outside layer or layers is, in the interest of foldability and absorbency, as low as possible, for example 6 grams per square meter each for a fiber titer of 1.7 dtex.

The non-absorbent surface of the sponge can be rough or smoothed; the rough surface is more suitable for products for the cleaning of wounds, the latter for bandage pads (minimum adhesion to the wound).

In a special development of the sponge according to the invention, at least one layer of fibers contains crimped polyester fibers. These produce a mechanical consolidation of the unperforated zones, both in and perpendicular to the fiber planes. The degree and direction of this consolidation can easily be varied by the number of crimped fibers and by the fiber orientation. Such sponges are characterized, on account of their greater bulk, especially after repeated folding, by a greater fluid absorption capacity.

The sponge according to the invention has many applications both in the medical and in the hygienic fields. It has an absorbency at least equal to the known, perforated layered nonwovens, yet contains no binding agent additives, and is nevertheless free of fluff and very resistant to tearing.

The openings in the covering, which are formed by the welded component fibers, are irregular and sufficiently large to assure a reliable transfer of the secretions toward the absorbent layer. In other words, the same effect is achieved with this entirely nonwoven article as with the known two-ply coverings of nonwoven and woven fabric, without the need to provide such a woven fabric.

Adhesion to the wound is effectively prevented by the moisture-repellent fiber overlay, which may be smoothed in some cases. Moreover, the sponge can be folded repeatedly without harm, and can easily be sealed thermally in this state to form a very bulky sponge. Due to the content of thermoplastic fibers in the outer layers, it can be welded along its margins, after a single folding in the case of two-layer configurations, to make an absorbent pad at whose sides any undesirable escape of fibers from the absorbent layer is thus reliably prevented.

The process of the invention for the production of the sponge of the invention consists first in the laying of at least two fiber layers one on the other, one of which contains the known absorbent fibers and the other moisture-repellent thermoplastic heterofil filaments. For the outer moisture-repellent layer or layers, at least 80% of heterofil filaments are used. The fiber sandwich is then exposed to thin water jets of such low energy that no substantial fiber entanglement takes place, but only a hydraulic perforation.

The hydraulic perforation with low-energy water jets necessitates, however, an additional consolidation, since this perforation does not achieve fiber entanglement or form an attrition-resistant surface. In the present invention, this process is applied without the use of a binding agent, since heterofil fibers alone produce the consolidation.

For the perforation of the fiber sandwich, water is pumped through slotted nozzles extending over the entire width of the material, at a pressure just sufficient for the perforation. Further details of a suitable apparatus is described at length in French Patent Application FR-A No. 5,536,432.

The "water curtain" that forms strikes against a perforated, rotating pattern moving with the fiber layers, and the fiber sliver underneath it is perforated by the water passing through it, according to the hole pattern of the mask, without any substantial tangling. The open area of the hole mask is best made as great as possible, because the remaining portions of the perforated nonwoven are thus made very bulky, and thus more capillary space is created in the finished product to absorb additional liquid. Also, these bulky portions increase the abrasivity of the surface, which is advantageous especially for wound cleaning purposes and cosmetic applications.

After perforation, the water is removed by drying, the material is thermally consolidated at a temperature above the melting point of the low-melting component of the heterofil filaments, and afterward, if desired, the water-repellent surfaces are smoothed.

Both core-and-jacket and conjugated (side-by-side) fibers can be used as heterofil filaments.

To increase strength and reduce the tendency to adhere to wounds, the external surfaces of the dried and consolidated sponge, consisting of heterofil filaments, can be thermally smoothed by the known calendering process. If it is desired to leave the bulk of the product relatively great, the smoothing is performed in the gap between two smooth rolls, i.e., with a relatively low pressure. By varying the size of the gap, the bulk of the sponge can be varied as desired.

Better draping or folding qualities, on the other hand, are attained by welding over less than the entire surface, in which case it is then best for the engraving depth of the roller to not be too shallow, for the sake of bulk.

In a special embodiment of the invention, one or more fiber layers are blended with polyester fibers that have a high shrinkage in hot water or steam. During the drying process, the perforated, still-wet sheet of material shrinks. This produces a mechanical consolidation by the compression of the fiber clusters between the perforations, and partially by the reorientation of the fibers to the vertical. How great the amount of shrinkage lengthwise and crosswise will be depends primarily on the fiber orientation and the content of shrinking fibers. After the drying has ended, the fiber consolidation is again performed by exceeding the melting temperature of the low-melting component of the heterofil fiber. The above-mentioned reorientation of the fibers entails a gain in bulk, which, after folding one or more times, results in an increased capacity for absorbing liquids.

For the achievement of a high rate of production and thereby economical manufacture, the fiber slivers are usually laid down with a longitudinal orientation. The very low transverse strength which this entails can, if necessary, be increased simply by laying down each layer at right angles to the layer beneath it. Such an arrangement is advantageous especially for surgical sponges for the operating room where great resistance to tearing is required.

To prevent any yellowing or other thermal damage to the inner, absorbent fiber layer, the low-melting component should be able to be activated at a temperature which can still be withstood without harm by the absorbent fibers. Heterofil fibers of this kind consist, for example, of polyethylene tererphthalate and polyethylene (or polypropylene).

The fiber having the polypropylene component is also resistant to steam sterilization. This embodiment of the invention is therefore preferred for folded compresses to be sterilized in autoclaves. In the interest of good folding qualities, the titer of all fibers must be as small as possible, i.e., they must have very little stiffness. A minimum titer is 1 dtex.

The method according to the invention permits the continuous, inexpensive and rapid manufacture of highly effective textile pads and sponges. It is important that the hydraulic perforation is performed according to the invention by a low-energy "water curtain". This, together with post-consolidation without binding agent, satisfies all of the requirements stated in specifying the object of the invention, applying to a textile laminate to be used both for medical and hygienic purposes.

The various features of novelty which characterize the invention are pointed out with particularity in the claims annexed to and forming a part of this specification. For a better understanding of the invention, its operating advantages and specific objects obtained by its use, reference should be had to the accompanying Figures and descriptive matter in which there is illustrated and described a preferred embodiment of the invention.

DESCRIPTION OF PREFERRED EMBODIMENT

A preferred embodiment is hereunder described by reference to the following including, Examples and FIGS. 1 and 2.

Figure 1:
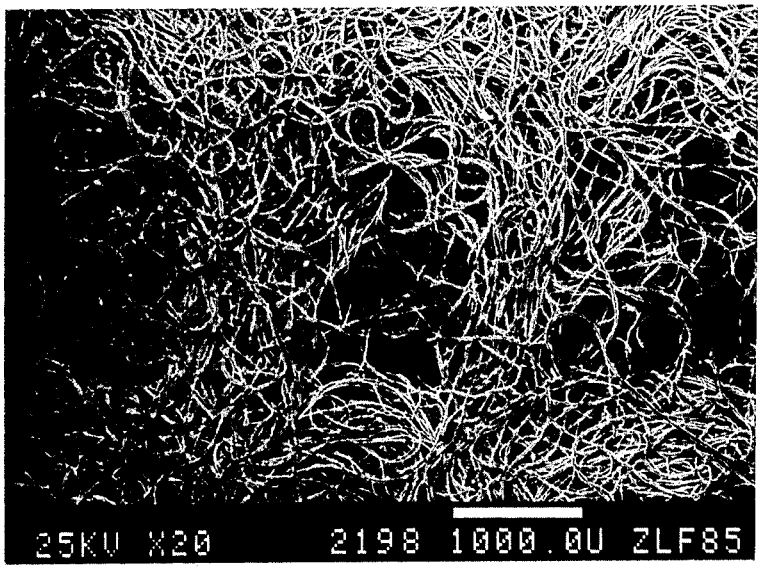
FIG. 1 is a plan view of a sponge according to the present invention in a 20x enlargement.

FIG. 1 shows how, in a sponge of the invention according to Example 1, the hydraulic perforation with water jets of low energy produces a perforation without substantially greater fiber entanglement in the area of the holes than in the unperforated zones.

Figure 2:
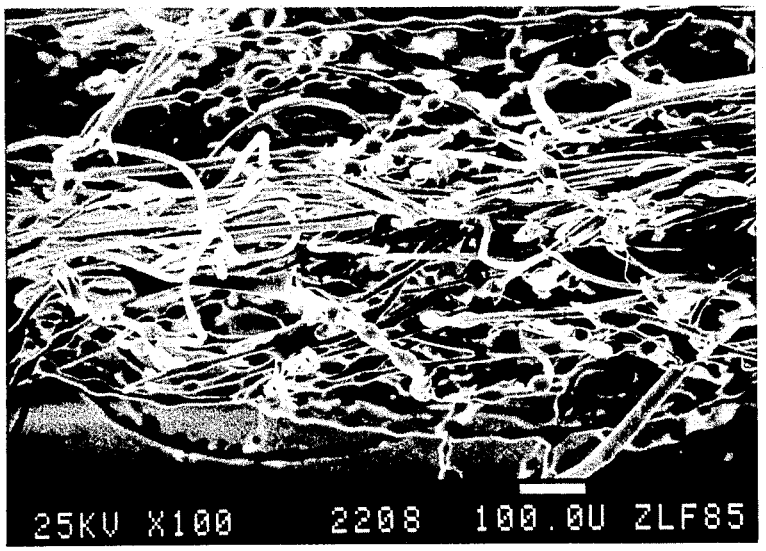
FIG. 2 is a cross section through a three-layer sponge of the invention in a 100x enlargement.

FIG. 2, a cross section through the sponge according to Example 1, clearly shows that, after the laying, perforation and consolidation of the nonwoven sandwich, the latter is no longer simply a layered material, since the upper and lower (moisture-repellent) fiber layers partially penetrate or tangle with the absorbent middle layer.

EXAMPLES

EXAMPLE 1

A staple fiber mat composed of three layers is produced from a plurality of combs. Each of the two outside layers consists of 7 grams per square meter of a two-component polyester and polyethylene heterofil fiber of a titer of 1.7 dtex and a cut length of 40 mm. The absorbent middle layer consists of 26 grams per square meter of 80% viscose cellulose of a titer of 1.3 dtex and a cut length of 40 mm, plus 20% of the heterofil fibers specified above.

The staple fiber laminate, with a total weight of 40 grams per square meter is thoroughly wetted with water by spraying before hydraulic perforation. The hole mask contains rectangular perforations measuring 1.4 mm across the direction of movement and 2.5 mm lengthwise thereof. The bridge widths amount to 0.50 mm throughout. The open area is approximately 55% of the total mask surface.

The thin water curtain (approximately 60 microns) coming from a slot nozzle strikes the mask with a pressure of about 10 bar. After perforation the material is dried at 160° C. with warm circulating air and consolidated. The result is a bulky, highly absorbent, and yet attritionresistant medical sponge. The sponge was tested for Demand Absorbency (DA). The method and the apparatus for measuring the absorbency are as described in "DEMAND WETTABILITY" (INDA Technical Symposium, March 1974, pages 129 to 142). The liquid was synthetic urine being composed of:

388.000 g urea;
159.080 g NaCl;
22.116 g $MgSO_4.7\ H_2O$;
12.416 g $CaCl_2.2\ H_2O$;
39.576 g $K_2SO_4$;
2.000 g naphthol red;
1.000 g iso-octylphenol-polyethoxyethanol with ca. 40 ethoxyl units; and
18.930 g distilled water.

The 3-layer-sponge, when pleated in a 4×3-layer-testing product, has a considerably higher moisture absorbency based on Demand Absorbency (DA) of 30.3 g/g than cotton gauze or commercial, water-jet needled products both in the folded and unfolded state.

Prior art materials were tested, and the Demand Absorbency (DA) was evaluated in grams/grams (g/g) after a wetting period of 3 minutes:

(a) NU-GAUZE (trademark of Johnson & Johnson); water jet-perforated and fiber-entangled, fleece made of a mixture of rayon staple and polyester fibers;
4 layers, 47 g/$m_2$ each:
DA = 13.2 g/g.

(b) SOFNET II (trademark of Johnson & Johnson); water jet-perforated and fiber-entangled fleece made of rayon staple;
4 layers, 37 g/$m_2$ each:
DA = 14.2 g/g.

(c) Cotton mull; 17 filaments; 12 layers; 23 g/$m_2$ each:

DA=8.1 g/g.

A mull made of a cotton web is normally pleated in 12 layers, a comparable nonwoven substitute requires only 4 layers because of its higher absorbency and weight. So, in the testing procedure, the mull-sample consisted of 12 layers, the nonwoven samples of 4 layers, each sample having a diameter of 36 millimeters. It has to be clarified herewith, that the sponge according to example 1 consists of 3 layers and is pleated in 4 layers, each of it being built up of those 3 layers.

EXAMPLE 2

The sponge prepared according to Example 1 is smoothed on one side at 105° C. against a smooth, PTFE-coated fabric. The result in an absolutely fluff-free, smooth surface. The material is superior to gauze and gauze substitute based on water-jet needled nonwoven fabric as to nonadherence to wounds. The DA was 27.3 g/g (4 layers of three, each).

It will be understood that the specification and examples are illustrative but not limitative of the present invention and that other embodiments within the spirit and scope of the invention will suggest themselves to those skilled in the art.

We claim:

1. A nonwoven textile sponge comprising at least one absorbent fiber layer and at least one perforated water-repellent outer fiber layer covering it on a wound side thereof, the repellent fiber layer consisting of at least 80% of synthetic heterofil filaments having a low-melting and a high-melting component, said fiber layers merged flowingly with one another as a result of heating, wherein the perforated regions contain no substantial fiber entanglement, and the entire material is consolidated thermally exclusively by the bonded filaments without binding agents.

2. The sponge of claim 1, wherein the sponge is suitable for use in medical and hygienic applications.

3. The sponge of claim 1, wherein the absorbent layer contains up to 30% heterofil filaments of the kind used in the water-repellent layer.

4. The sponge of claim 1, wherein the absorbent layer contains polyvinyl alcohol fibers which soften in hot water.

5. The sponge of claim 1, wherein the absorbent zone consists exclusively of cellulose layers.

6. The sponge of claim 1, wherein at least one fiber layer contains shrunken polyester fibers.

7. The sponge of claim 1, wherein the absorbent layer is mixed with binding fibers.

8. A method for the production of a nonwoven, textile sponge for medicine and hygiene, having at least one absorbent fiber layer containing, in some cases, binding fibers, and at least one external layer containing water-repellent fibers, said water-repellent fiber layer having at least 80% synthetic heterofil filaments with a low-melting and a high-melting component, comprising:

covering one of the layers with the other to form a sandwich, hydraulically perforating the sandwich by means of a slotted water nozzle and a hole mask with water streams of such low impact energy that no substantial fiber entanglement develops in the hole areas;

drying the perforated sandwich; and consolidating the sandwich under pressure at a temperature above the melting point of the low-melting component, without the addition of a binding agent.

9. The method of claim 8, further comprising thermally smoothing at least one surface of the sponge.

10. The method of claim 8, wherein the least one fiber layer is provided with polyester fibers which can be shrunk in hot water or steam.

11. The method of claim 10, wherein the shrinkage is performed simultaneously with the drying.

12. The method of claim 8, wherein at least one cellulose layer is used exclusively for the absorbent layer.

13. The method of claim 12, wherein the least one cellulose layer is moistened before the hydraulic perforation.

14. The method of claim 10, wherein at least one cellulose layer is used exclusively for the absorbent layer.

15. The method of claim 14, wherein the least one cellulose layer is moistened before the hydraulic perforation.

* * * * *